US006030000A

United States Patent [19]

Diamond

[11] Patent Number: 6,030,000

[45] **Date of Patent: *Feb. 29, 2000**

[54] NEGOTIABLE DOCUMENT HAVING ENHANCED SECURITY FOR DETERRING FRAUD BY USE OF A THERMOCHROMATIC FINGERPRINT IMAGE

[75] Inventor: Robert I. Diamond, Alpine, Utah

[73] Assignee: Diamond Security, Inc., Alpine, Utah

[ * ] Notice: This patent is subject to a terminal disclaimer.

[21] Appl. No.: 08/958,146

[22] Filed: Oct. 24, 1997

Related U.S. Application Data

[63] Continuation-in-part of application No. 08/933,624, Sep. 12, 1997.

[51] Int. Cl.[7] ..... B42D 15/00

[52] U.S. Cl. ..... 283/58; 283/57

[58] Field of Search ..... 283/57, 58, 74, 283/75, 78, 114, 113, 67

[56] References Cited

U.S. PATENT DOCUMENTS

| | | | |
|---|---|---|---|
| 1,383,792 | 7/1921 | Dickinson . | |
| 2,500,612 | 3/1950 | Krogh | 41/4 |
| 3,447,818 | 6/1969 | Pizzol | 283/7 |
| 3,709,524 | 1/1973 | McKee et al. | 282/22 |
| 3,829,133 | 8/1974 | Smagala-Romanoff | 283/58 |
| 4,210,346 | 7/1980 | Mowry, Jr. et al. . | |
| 4,227,719 | 10/1980 | McElligott et al. . | |
| 4,227,720 | 10/1980 | Mowry, Jr. et al. . | |
| 4,265,469 | 5/1981 | Mowry, Jr. et al. . | |
| 4,310,180 | 1/1982 | Mowry, Jr. et al. . | |
| 4,341,404 | 7/1982 | Mowry, Jr. et al. . | |
| 4,351,547 | 9/1982 | Brooks, II . | |
| 5,085,936 | 2/1992 | Herdman | 428/337 |
| 5,149,140 | 9/1992 | Mowry, Jr. et al. | 283/93 |
| 5,189,292 | 2/1993 | Batterman et al. | 235/494 |
| 5,263,742 | 11/1993 | Koch | 283/78 |
| 5,375,886 | 12/1994 | Tsuchiya | 283/93 |
| 5,575,508 | 11/1996 | Diamond | 283/93 |
| 5,591,255 | 1/1997 | Small et al. | 106/21 A |
| 5,613,712 | 3/1997 | Jeffens | 283/78 |
| 5,785,353 | 7/1998 | Diamond | 283/67 |

OTHER PUBLICATIONS

Publication Entitled: "*Primer on Security Features*"; PRIMERSF, Apr. 4, 1994, pp. 1–6.

FormsTronics Sales Brochure Flyer Entitled: "*FringerprinT-securIty Sample*"; Approximately Aug. 1997.

Copy of Check Form by FormsTronics (FTI 10195); Approximately Aug. 1997.

*Primary Examiner*—Willmon Fridie, Jr.

*Attorney, Agent, or Firm*—Russell N. Rippamonti; Jenkens & Gilchrist, P.C.

[57] ABSTRACT

A negotiable document having enhanced security for deterring fraud includes at least one thermochromatic fingerprint image printed with thermochromatic ink, wherein said thermochromatic fingerprint image will fade when heat is transferred to the image from a live human hand. The negotiable document further includes a warning clause that the negotiable document may be fraudulent without the thermochromatic fingerprint image.

10 Claims, 5 Drawing Sheets

NEGOTIABLE DOCUMENT HAVING ENHANCED SECURITY FOR DETERRING FRAUD BY USE OF A THERMOCHROMATIC FINGERPRINT IMAGE

This application, entitled A NEGOTIABLE DOCUMENT HAVING ENHANCED SECURITY FOR DETERRING FRAUD BY USE OF A THERMOCHROMATIC FINGERPRINT IMAGE, is a continuation-in-part of U.S. Ser. No. 08/933,624, filed Sep. 12, 1997 entitled A NEGOTIABLE DOCUMENT HAVING ENHANCED SECURITY FOR DETERRING GENERATION OF COPIES BY USE OF THERMOCHROMATIC INK, currently pending.

TECHNICAL FIELD

This invention relates to negotiable documents and, more particularly, to a negotiable document using a thermochromatic fingerprint image for deterring fraud.

BACKGROUND OF THE INVENTION

A major problem within the negotiable document industry is the increasing risks arising from the fraudulent presentation of negotiable documents by unauthorized individuals. Improvements in photocopy technology have made it difficult to tell whether a negotiable document is the true original or a fraudulent high quality photocopy thereof. Alternatively, improvements in laser printing and other printing technology have made it possible to print fraudulent original negotiable documents with a payor's customized information thereon. It may be extremely difficult for a merchant or financial institution to determine if the negotiable document presented to them is a photocopy or fraudulently printed document. Many millions of dollars of checks are presented to merchants and financial institutions each year. A negotiable document having enhanced security deterring fraudulent copying, fraudulent passing off and fraudulent presentment is needed.

SUMMARY OF THE INVENTION

The foregoing and other problems are overcome by the present invention. The negotiable document claimed in the present invention includes enhanced security for deterring the fraudulent photocopying, passing off and fraudulent presentment by use of a thermochromatic fingerprint image printed, embossed or stamped on the front or back of a negotiable document.

The presence of the thermochromatic image inhibits the fraudulent photocopying and or printing of the negotiable document of the present invention because present technology photocopiers and laser printers are not capable of printing checks with thermochromatic images.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION

Figure 1:
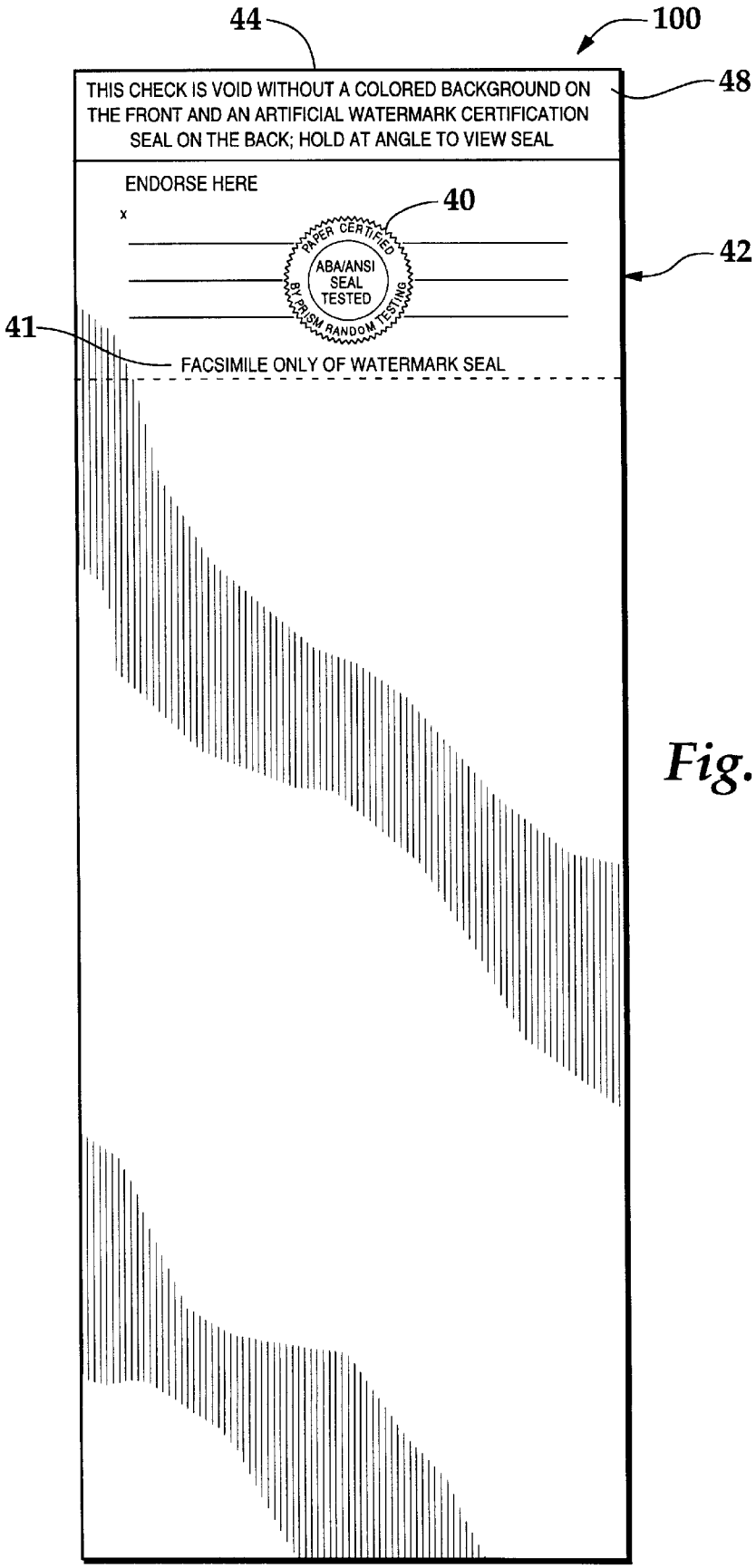
FIG. 1 illustrates the back of a first negotiable document having an endorsement area containing a representation of a watermark certification seal incorporated onto the document for deterring the fraudulent photocopying of the subject negotiable document.

Referring now to the Drawings, and more particularly to FIG. 1, there is illustrated a watermark certification seal representation 40 incorporated into the background of an endorsement area 42 of a negotiable document 100. As used herein negotiable document may include checks, drafts, grade transcripts, report cards, badges, identification cards, licenses, stock certificates, letters of credit and money orders. The endorsement area 42 comprises an area located at the top edge 44 of the negotiable document. The face 46 of the endorsement area 42 may be covered by a pantographic background design as described in U.S. Pat. No. 5,641,183 or, alternatively, may include a warning phrase generated with a different first and second dot size and/or density as illustrated and described in U.S. Pat. No. 5,575,508, both patents by the inventor hereof and incorporated herein by reference. At some location within the endorsement area 42, the watermark certification seal representation 40 is included. The watermark certification seal representation 40 is a replica of at least one or more artificial watermark certification seals (not shown) placed upon other locations of the check or negotiable document. A notification 41 placed at the bottom of the endorsement area 42 notifies a user that the watermark certification seal representation 40 is only a facsimile of the actual watermark certification seal (not shown). By placing the watermark certification seal representation 40 within the endorsement area 42, an individual can quickly determine what they are looking for when trying to ascertain the existence of an artificial watermark certification seal in other locations on the check. A warning clause 48 notifies users of various security features used on the check.

Figure 2:
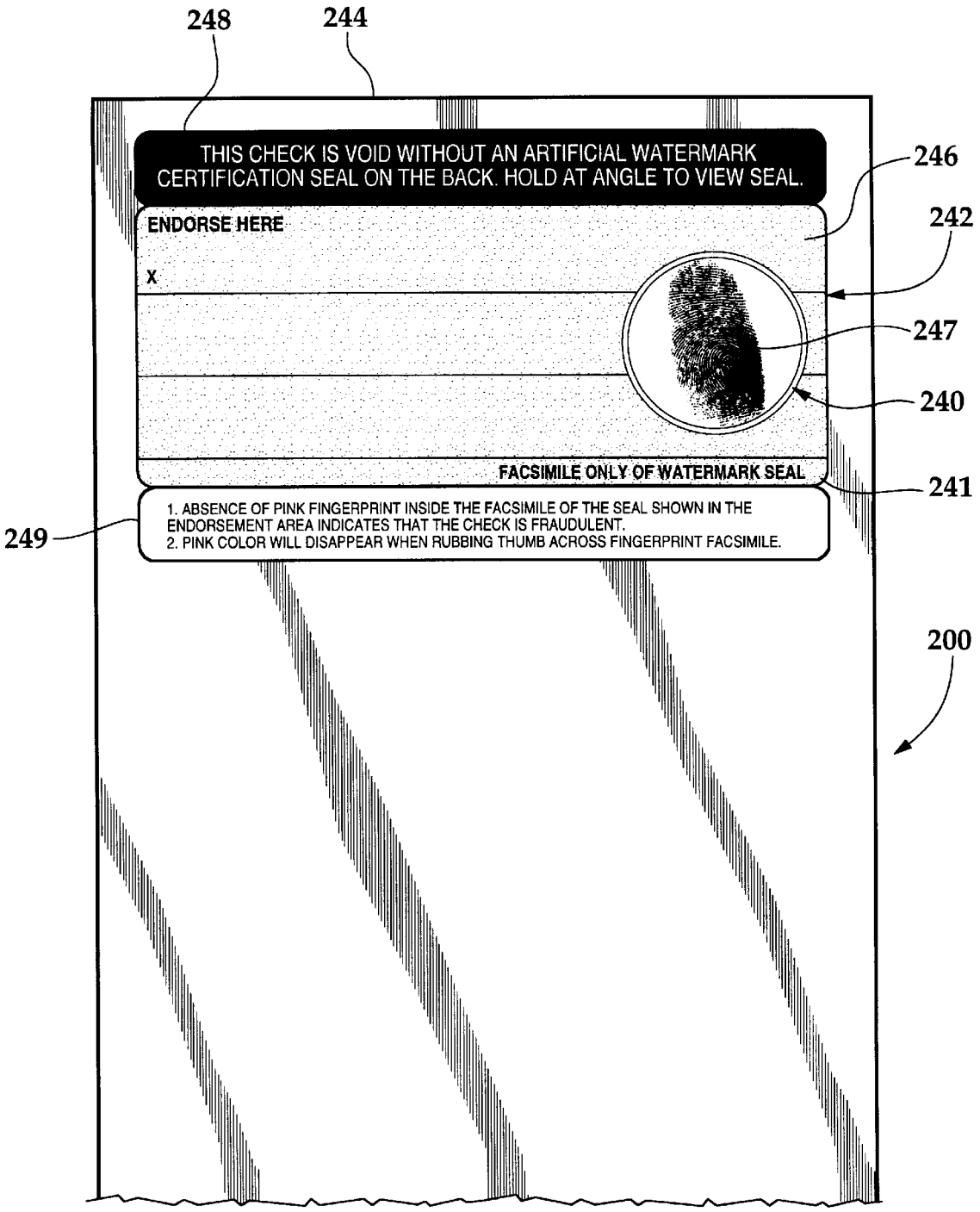
FIG. 2 illustrates the back of a second negotiable document using a thermochromatic facsimile of a watermark for deterring the fraudulent photocopying of the subject negotiable document.

Referring now to FIG. 2, there is shown a second embodiment 200 of the present invention wherein a watermark representation 240 is incorporated into the background of the check endorsement area 242. The endorsement area 242 comprises an area located proximal to a top edge 244 of the check 200. The face 246 of the endorsement area 242 may be covered by a pantographic background design similar to the pantographic background design as illustrated in U.S. Pat. No. 5,641,183 or, alternatively, may include a warning phrase generated with a different first and second dot size and/or density as illustrated and described in U.S. Pat. No. 5,575,508. At some location within the endorsement area 242, the watermark representation 240 is included. The watermark representation 240 is a replica of the artificial watermark (not shown) placed upon other locations of the check or negotiable document. It will be understood that a true fourdrinier watermark incorporated in the paper from which the negotiable document 200 is printed may be used instead of an artificial watermark as discussed herein.

The watermark representation 240 may comprise a fingerprint 247 or thumb print or any other body print (hereinafter referred to collectively as "fingerprint"). The fingerprint may be customized by printing the actual fingerprint of an individual on whose account the negotiable document is to be drawn or the fingerprint of the person authorized to sign the negotiable document.

In the embodiment of the present invention, the watermark representation 240 is printed with a thermochromatic ink such as the ink described in U.S. Pat. No. 5,591,255 issued to Small and Highberger, the disclosure of which is incorporated herein by reference. The thermochromatic ink is commercially available from Chromatic Technology, Inc. at 4320 Northpark Dr., Suite B, Colorado Springs, Colo. 80907 under the trade name THERMOCHROMIC. The thermochromatic ink includes the thermochromatic property that when heat is transferred to the ink, the ink will visually fade and disappear. The ink begins fading at approximately 80° F. The most convenient form of heat transfer may be made by rubbing the thumb or finger of a live human hand over the watermark representation 240. The heat generated from rubbing with the human finger will be transferred to the ink and result in the fading of the ink. Heat may also be transferred to the ink by pressing the human finger against the seal as the average human body temperature of 98.6° F. is above the 80° F. point where the thermochromatic properties of the ink are activated or, alternatively, by rubbing the representation 240 with the thumb or finger. When the contact is stopped and the paper returns to ambient temperature the image will reappear. It will be understood by those skilled in the art that the watermark representation 240 may be configured as a fingerprint 247 as shown in FIG. 2 or as a certification seal 40 as shown in FIG. 1 or any other configuration.

In the second embodiment of the invention 200, a notification 241 is placed at the bottom of the endorsement area 242 to notify a user that the watermark representation 240 is only a facsimile of the artificial or fourdrinier watermark (not shown). By placing the watermark representation 240 within the endorsement area 242, an individual can quickly determine what they are looking for when trying to ascertain the existence of an artificial or fourdrinier watermark in other locations on the check. It will be understood by those skilled in the art that the artificial watermark and the artificial watermark representation 242 may be placed at any location on the front or back side of the negotiable document and is not limited to the location as shown in FIG. 2.

A warning clause 248 notifies users of the presence of the artificial or fourdrinier watermark and that the artificial watermark may be viewed by holding the check at an angle. Additionally, the check 200 will include a warning 249 that absence of the watermark representation 240 from the endorsement area indicates that the check is fraudulent and that the representation 240 will disappear when rubbing a thumb or finger across the representation 240 because of the thermochromatic properties of the ink.

Figure 3:
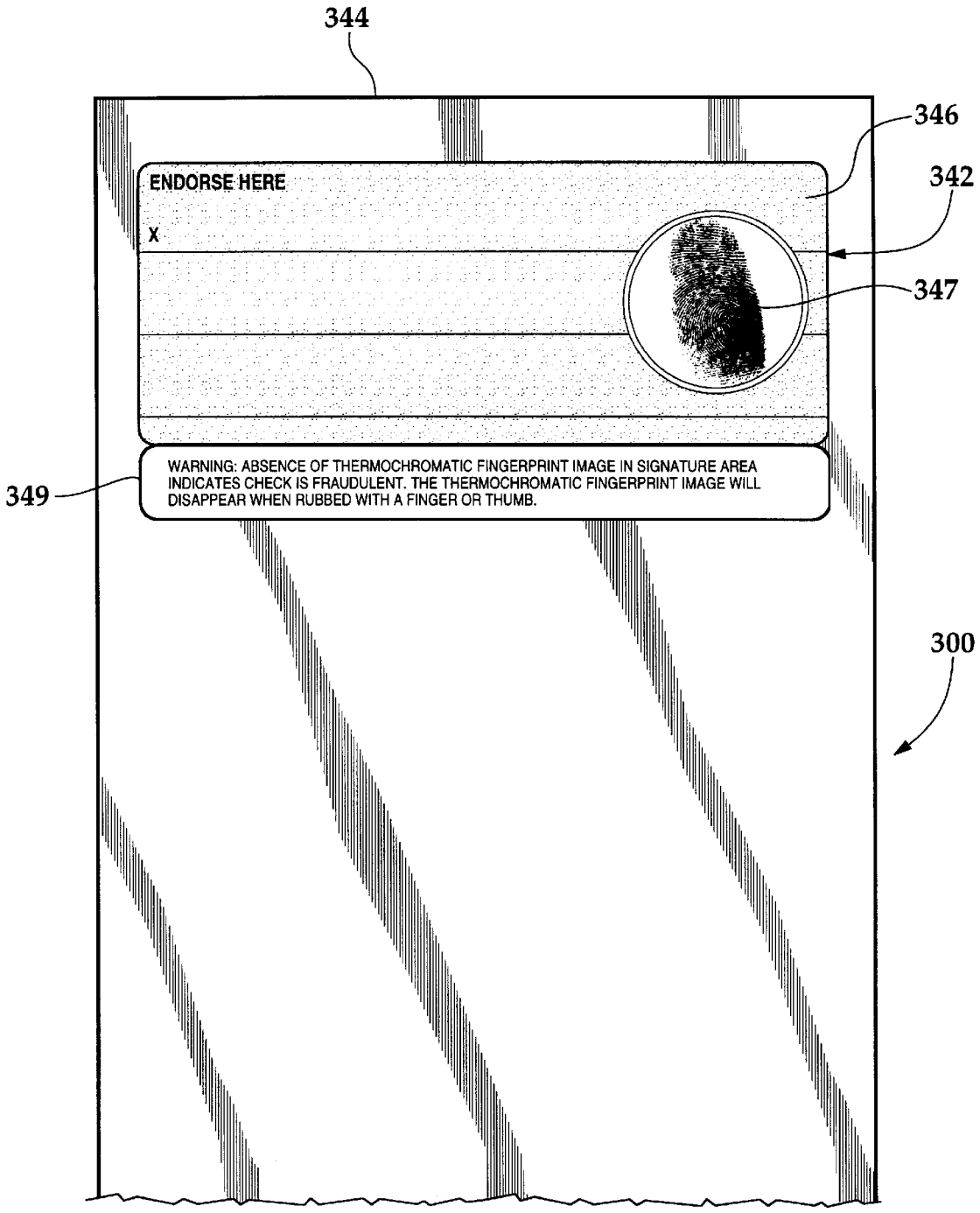
FIG. 3 illustrates the back of a third negotiable document containing a thermochromatic fingerprint image printed thereon for deterring check fraud.

Referring now to FIG. 3, there is shown a third embodiment 300 of the present invention wherein a thermochromatic fingerprint image 347 is printed in the endorsement area 342 on the back of the negotiable document 300. The endorsement area 342 comprises an area located proximal to a top edge 344 of the check 300. The face 346 of the endorsement area 342 may be covered by a pantographic background design similar to the pantographic background design as illustrated in U.S. Pat. No. 5,641,183 or alternatively may include a warning phrase generated with a different first and second dot size and/or density as illustrated and described in U.S. Pat. No. 5,575,508. At some location within the endorsement area 342, the thermochromatic fingerprint image 347 is included.

The thermochromatic fingerprint image 347 may comprise a fingerprint or thumb print or any other body print (hereinafter referred to collectively as "fingerprint"). The fingerprint may be customized by printing the actual fingerprint of an individual on whose account the negotiable document is to be drawn or the fingerprint of the person authorized to sign the negotiable document.

In the embodiment of the present invention, the thermochromatic fingerprint image 347 is printed with a thermochromatic ink such as the ink described in U.S. Pat. No. 5,591,255 issued to Small and Highberger, the disclosure of which was discussed with regard to the second embodiment of the present invention. The thermochromatic ink includes the thermochromatic property that when heat is transferred to the ink, the ink will visually fade and disappear. The ink begins fading at approximately 80° F. The most convenient form of heat transfer may be made by rubbing the thumb or finger of a live human hand over the thermochromatic fingerprint image 347. The heat generated from rubbing with the human finger will be transferred to the ink and result in the fading of the ink. Heat may also be transferred to the ink by pressing the human finger against the seal as the average human body temperature of 98.6° F. is above the 80° F. point where the thermochromatic properties of the ink are activated or, alternatively, by rubbing the thermochromatic fingerprint image 347 with the thumb or finger. When the contact is stopped and the paper returns to ambient temperature, the image will reappear. It will be understood by those skilled in the art that the thermochromatic image 347 may be configured as a fingerprint as shown in FIG. 3 or as a certification seal 40 as shown in FIG. 1 or any other configuration.

A warning clause 349 notifies users that absence of the thermochromatic fingerprint image 347 from the endorsement area indicates that the check is fraudulent and that the representation 347 will disappear when rubbing a thumb or finger across the image 347 because of the thermochromatic properties of the ink.

The presence of the thermochromatic image inhibits the fraudulent photocopying of the negotiable document of the present invention because present technology photocopiers and laser printers are not capable of printing checks with thermochromatic images.

Figure 4:
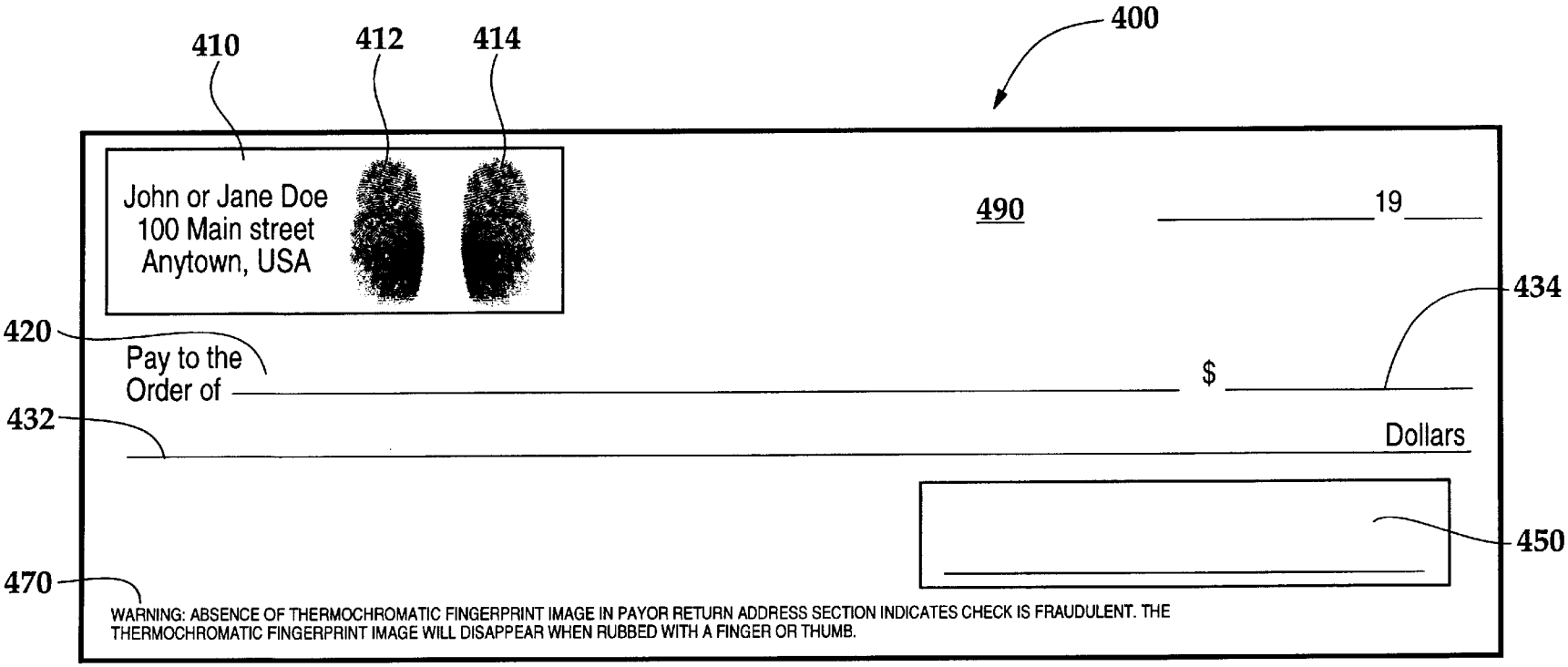
FIG. 4 illustrates the front of a fourth negotiable document containing a facsimile fingerprint image printed thereon for deterring check fraud.

Referring now to FIG. 4, there is shown a fourth embodiment 400 of the present invention. The front of the negotiable document includes a payor identification portion 410, a payee identification portion 420, a payment amount portions 432 and 434 and a signature portion 450. The payor information section may include a first thermochromatic fingerprint image 412 and a second thermochromatic fingerprint image 414 printed, embossed or stamped thereon. In the preferred embodiment, the fingerprints will be of the joint owners of the account on which the negotiable document is drawn, the payors. In the instance of corporate checks the facsimile fingerprints may be those of the authorized signers of the negotiable document.

The face 490 of the negotiable document 400 may be covered by a various pantographic background design similar to the pantographic background design as illustrated in U.S. Pat. No. 5,641,183 or, alternatively, may include a warning phrase generated with a different first and second dot size and/or density as illustrated and described in U.S. Pat. No. 5,575,508.

It will be understood that the thermochromatic fingerprint 412 or 414 may comprise a fingerprint or thumb print or any other body print (hereinafter referred to collectively as "fingerprint"). The thermochromatic fingerprint image 412 or 414 is printed with a thermochromatic ink such as the ink described in U.S. Pat. No. 5,591,255 issued to Small and Highberger, the disclosure of which was discussed with regard to the second embodiment of the present invention and has thermochromatic properties as heretofore described with regard to the second and third embodiments. It will be understood by those skilled in the art that the facsimile fingerprint 412 or 414 may be placed at any location on the front side of the negotiable document and is not limited to the location as shown in FIG. 4.

A warning clause 470 notifies users that absence of the thermochromatic fingerprint image 412 or 414 from the payor return address section indicates that the check is fraudulent and that the representation 412 or 414 will disappear when rubbing a thumb or finger across the image because of the thermochromatic properties of the ink.

The presence of the thermochromatic image inhibits the fraudulent photocopying of the negotiable document of the present invention because present technology photocopiers and laser printers are not capable of printing checks with thermochromatic images.

Figure 5:
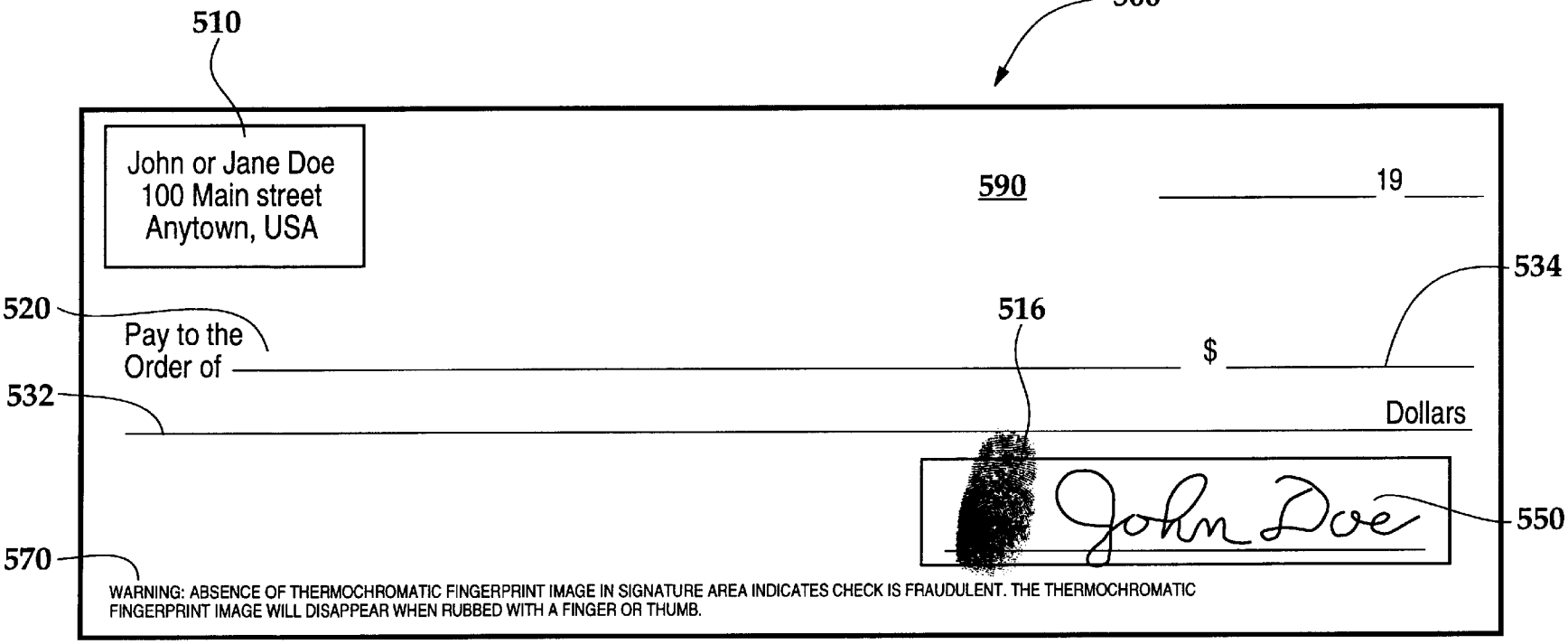
FIG. 5 illustrates the front of a fifth negotiable document containing a facsimile fingerprint image printed thereon by a signature plate for deterring check fraud.

Referring now to FIG. 5, there is shown a fifth embodiment 500 of the present invention. The front of the negotiable document includes a payor identification information section 510, a payee identification section 520, a payment amount section 532 and 534 and a signature section 550.

The face 590 of the negotiable document 500 may be covered by a various pantographic background designs similar to the pantographic background design as illustrated in U.S. Pat. No. 5,641,183 or, alternatively, may include a warning phrase generated with a different first and second dot size and/or density as illustrated and described in U.S. Pat. No. 5,575,508.

It is common in many moderate size to large size businesses to use a signature plate that impresses or stamps a signature in the signature area of a negotiable document. In this embodiment, the signature plate further includes a thermochromatic fingerprint image 516 of the same individual whose authorized signature appears on the plate. It will be understood that the thermochromatic fingerprint 516 may comprise a fingerprint or thumb print or any other body print (hereinafter referred to collectively as "fingerprint"). The thermochromatic fingerprint image 516 is printed with a thermochromatic ink such as the ink described in U.S. Pat. No. 5,591,255 issued to Small and Highberger, the disclosure of which was discussed with regard to the second embodiment of the present invention and has thermochromatic properties as heretofore described with regard to the second and third embodiments.

A warning clause 570 notifies users that absence of the thermochromatic fingerprint image 516 indicates that the check is fraudulent and that the representation 516 will disappear when rubbing a thumb or finger across the image because of the thermochromatic properties of the ink.

The presence of the thermochromatic image inhibits the fraudulent photocopying of the negotiable document of the present invention because present technology photocopiers and laser printers are not capable of printing checks with thermochromatic images.

Although preferred embodiments of the present invention have been illustrated in the accompanying Drawings and described in the foregoing Detailed Description, it will be understood that the invention is not limited to the embodiments disclosed. In particular, the present invention is not limited to thermochromatic images of fingerprint, thumbprint or body prints but may include other distinctive designs and is capable of numerous rearrangements, modifications and substitutions of parts and elements without departing from the spirit of the invention.

I claim:

1. A negotiable document having enhanced security for deterring fraud, including:

at least one thermochromatic image printed with thermochromatic ink, wherein said thermochromatic image will fade when heat is transferred to the image from a live human hand.

2. The negotiable document of claim 1 further including a warning clause that the negotiable document may be fraudulent without the thermochromatic image.

3. The negotiable document of claim 1 including a warning clause describing a thermochromatic property of the thermochromatic image.

4. The negotiable document of claim 1 wherein the thermochromatic image is located in the endorsement portion on a back side of the negotiable document.

5. The negotiable document of claim 1 wherein the thermochromatic image is located in the payor identification portion on a front face of the negotiable document.

6. The negotiable document of claim 1 wherein the thermochromatic image is a fingerprint.

7. A negotiable document having enhanced security for deterring fraud, including:

at least one thermochromatic image printed with thermochromatic ink, wherein said thermochromatic image will fade when heat is transferred to the image from a live human hand, said image being impressed by a signature plate concurrent with impressing an authorized signature.

8. The negotiable document of claim 6 further including a warning clause that the negotiable document may be fraudulent without the thermochromatic image.

9. The negotiable document of claim 6 including a warning clause describing a thermochromatic property of the thermochromatic image.

10. The negotiable document of claim 1 wherein the thermochromatic image is a fingerprint.

* * * * *